US009010219B2

(12) United States Patent
Feigel, Jr. et al.

(10) Patent No.: US 9,010,219 B2
(45) Date of Patent: Apr. 21, 2015

(54) COMPACT POWER TONG

(75) Inventors: Kurt R. Feigel, Jr., Edmonton (CA); Vladimir G. Pohnert, Edmonton (CA)

(73) Assignee: Universe Machine Corporation, Edmonton (CA)

( * ) Notice: Subject to any disclaimer, the term of this patent is extended or adjusted under 35 U.S.C. 154(b) by 1043 days.

(21) Appl. No.: 12/959,271

(22) Filed: Dec. 2, 2010

(65) Prior Publication Data

US 2011/0296958 A1 Dec. 8, 2011

(30) Foreign Application Priority Data

Jun. 7, 2010 (CA) ..... 2706500

(51) Int. Cl.
*B25B 17/00* (2006.01)
*E21B 19/16* (2006.01)

(52) U.S. Cl.
CPC ..... *E21B 19/164* (2013.01)

(58) Field of Classification Search
CPC ..... E21B 19/164
USPC ..... 81/57.15–57.21, 57.33–57.35
See application file for complete search history.

(56) References Cited

U.S. PATENT DOCUMENTS

| | | | | |
|---|---|---|---|---|
| 2,879,680 | A | 3/1959 | Beeman | |
| 4,084,453 | A | 4/1978 | Eckel | |
| 4,089,240 | A | 5/1978 | Eckel | |
| 4,192,206 | A * | 3/1980 | Schulze-Beckinghausen | 81/57.18 |
| 4,350,062 | A | 9/1982 | Farr | |
| 4,404,876 | A | 9/1983 | Eckel | |
| 4,487,092 | A | 12/1984 | Neves | |
| 4,576,067 | A | 3/1986 | Buck | |
| 4,593,584 | A * | 6/1986 | Neves | 81/57.18 |
| 4,631,987 | A | 12/1986 | Buck | |
| 4,649,777 | A | 3/1987 | Buck | |
| 4,709,599 | A | 12/1987 | Buck | |
| 5,144,868 | A | 9/1992 | Feigel, Jr. | |
| 5,150,642 | A * | 9/1992 | Moody et al. | 81/57.2 |
| 5,819,604 | A * | 10/1998 | Buck | 81/57.18 |
| 5,819,605 | A * | 10/1998 | Buck et al. | 81/57.33 |
| 5,904,075 | A * | 5/1999 | Buck | 81/57.18 |
| 6,058,811 | A * | 5/2000 | Stuart | 81/57.15 |
| 6,279,426 | B1 * | 8/2001 | Neves | 81/57.15 |
| 6,619,160 | B1 * | 9/2003 | Buck et al. | 81/57.18 |
| 6,761,090 | B2 * | 7/2004 | Dagenais et al. | 81/57.18 |
| 7,000,503 | B2 * | 2/2006 | Dagenais et al. | 81/57.35 |

(Continued)

FOREIGN PATENT DOCUMENTS

| | | | |
|---|---|---|---|
| CA | 1037463 | A | 8/1978 |
| CA | 1075676 | A | 4/1980 |

(Continued)

*Primary Examiner* — Lee D Wilson
*Assistant Examiner* — Melanie Alexander
(74) *Attorney, Agent, or Firm* — Christensen O'Connor Johnson Kindness PLLC

(57) ABSTRACT

A power tong for rotating a pipe, the power tong comprising: a frame having a pair of arcuate front portions defining a throat for receiving the pipe; a cage plate assembly mounted for rotation on the arcuate front portions about a center of rotation, the cage plate assembly having an opening that is alignable with the throat; a ring gear mounted for rotation within, and supported by, the cage plate assembly about the center of rotation, the ring gear having an opening that is alignable with the throat; the ring gear cooperating with jaws mounted on the cage plate assembly for gripping the pipe upon rotation of the ring gear.

4 Claims, 3 Drawing Sheets

(56) References Cited

U.S. PATENT DOCUMENTS

| | | | | |
|---|---|---|---|---|
| 8,006,590 | B2 * | 8/2011 | Light et al. | 81/57.15 |
| 2002/0157823 | A1 * | 10/2002 | Pietras et al. | 166/78.1 |
| 2004/0049905 | A1 * | 3/2004 | Jansch et al. | 29/428 |
| 2005/0235780 | A1 * | 10/2005 | Dagenais et al. | 81/57.35 |
| 2005/0241442 | A1 * | 11/2005 | Neves | 81/57.34 |
| 2006/0011017 | A1 * | 1/2006 | Kathan | 81/57.18 |
| 2006/0032339 | A1 * | 2/2006 | Dagenais et al. | 81/57.18 |
| 2007/0062339 | A1 * | 3/2007 | Dagenais et al. | 81/57.18 |
| 2008/0000330 | A1 * | 1/2008 | Basler et al. | 81/57.15 |
| 2009/0272231 | A1 * | 11/2009 | Musemeche et al. | 81/57.15 |
| 2009/0272233 | A1 * | 11/2009 | Musemeche | 81/57.16 |
| 2009/0277308 | A1 * | 11/2009 | Light et al. | 81/57.16 |
| 2010/0083796 | A1 * | 4/2010 | Nelson | 81/57.18 |

FOREIGN PATENT DOCUMENTS

| | | | |
|---|---|---|---|
| CA | 1088918 | A | 11/1980 |
| CA | 1190919 | A | 7/1985 |
| CA | 2016319 | C | 11/1991 |

* cited by examiner 10
36
42
14
11
80
13
15
34
81
62
48
17
12
100
46
81
23
34
30
19
43
14
21
19
80
91
56A
44
44
93
57
46
34
23
19
63
58
50
56A
58
63
48

COMPACT POWER TONG

TECHNICAL FIELD

This document relates to power tongs, in particular compact power tongs.

BACKGROUND

Power tongs are used in well drilling to rotate tubular sections that are being threaded together or unthreaded. There exist numerous patents on power tongs, including the following U.S. Pat. No. 5,144,868 to Feigel; U.S. Pat. No. 4,709,599 to Buck; U.S. Pat. No. 4,649,777 to Buck; U.S. Pat. No. 4,631,987 to Buck; U.S. Pat. No. 4,576,067 to Buck; U.S. Pat. No. 4,593,584 to Neves (equivalent to Canadian patent 1,235,111); U.S. Pat. No. 4,487,092 to Neves; U.S. Pat. No. 4,404,876 to Eckel; U.S. Pat. No. 4,350,062 to Farr et al., (equivalent to Canadian patent 1,125,737); U.S. Pat. No. 4,089,240 to Eckel, U.S. Pat. No. 4,084,453 to Eckel; and U.S. Pat. No. 2,879,680 to Beeman et al.; and the following Canadian patents: 1,190,919 to Farr et al., 1,088,918 to Eckel; 1,075,676 to Eckel; and 1,037,463 to Eckel.

All of these power tongs include a frame having arcuate front portions defining a throat, a ring gear mounted on the frame for rotation about a central axis, and a cage plate assembly mounted on either the frame or the ring gear for rotation about a central axis. The throat receives the tubular section to be rotated, and the cage plate and ring gear include die means for gripping the pipe. The ring gear and cage plate cooperate to rotate the pipe within the frame, which remains stationary.

SUMMARY

A power tong is provided for rotating a pipe, the power tong comprising: a frame having a pair of arcuate front portions defining a throat for receiving the pipe; a cage plate assembly mounted for rotation on the arcuate front portions about a center of rotation, the cage plate assembly having an opening that is alignable with the throat; a ring gear mounted for rotation within, and supported by, the cage plate assembly about the center of rotation, the ring gear having an opening that is alignable with the throat; the ring gear cooperating with jaws mounted on the cage plate assembly for gripping the pipe upon rotation of the ring gear.

These and other aspects of the device and method are set out in the claims, which are incorporated here by reference.

BRIEF DESCRIPTION OF THE FIGURES

Embodiments will now be described with reference to the Figures, in which like reference characters denote like elements, by way of example, and in which.

DETAILED DESCRIPTION

Immaterial modifications may be made to the embodiments described here without departing from what is covered by the claims.

Figure 2:
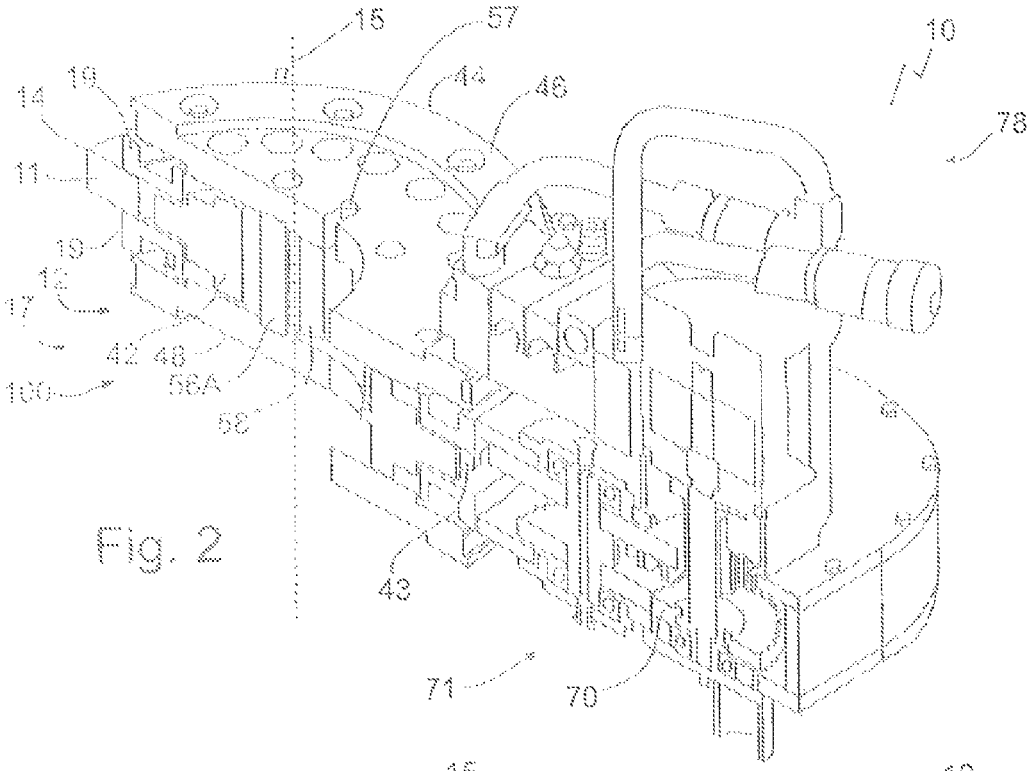
FIG. 2 is a cut-away perspective view of the power tong of FIG. 1.
Figure 1:
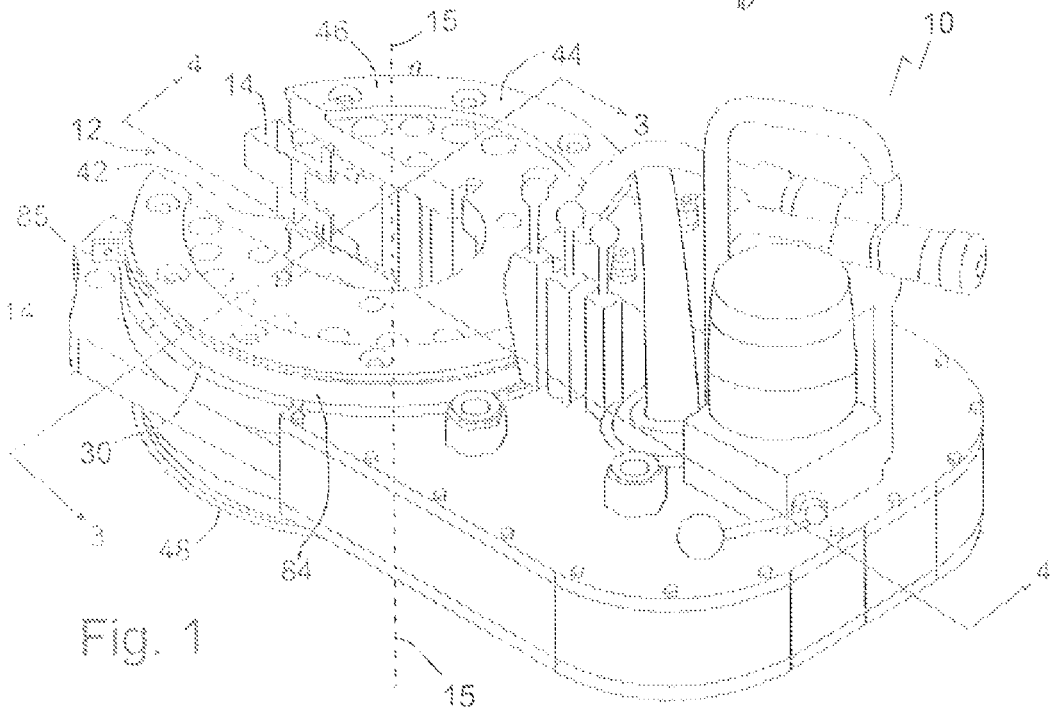
FIG. 1 is a perspective view of a power tong with a sliding die carrier.

Referring to the drawings and in particular to FIGS. 1 and 2, there is shown an open throat power tong 10 according to the present disclosure. In FIG. 2, the power tong body or frame 11 is illustrated cut in half, revealing the inner components of one side only. Tong 10 is a power tong for rotating a pipe 13 (shown in FIG. 3), tong 10 comprising a frame 11, a cage plate assembly 44, and a ring gear 42.

Figures 3, 4:
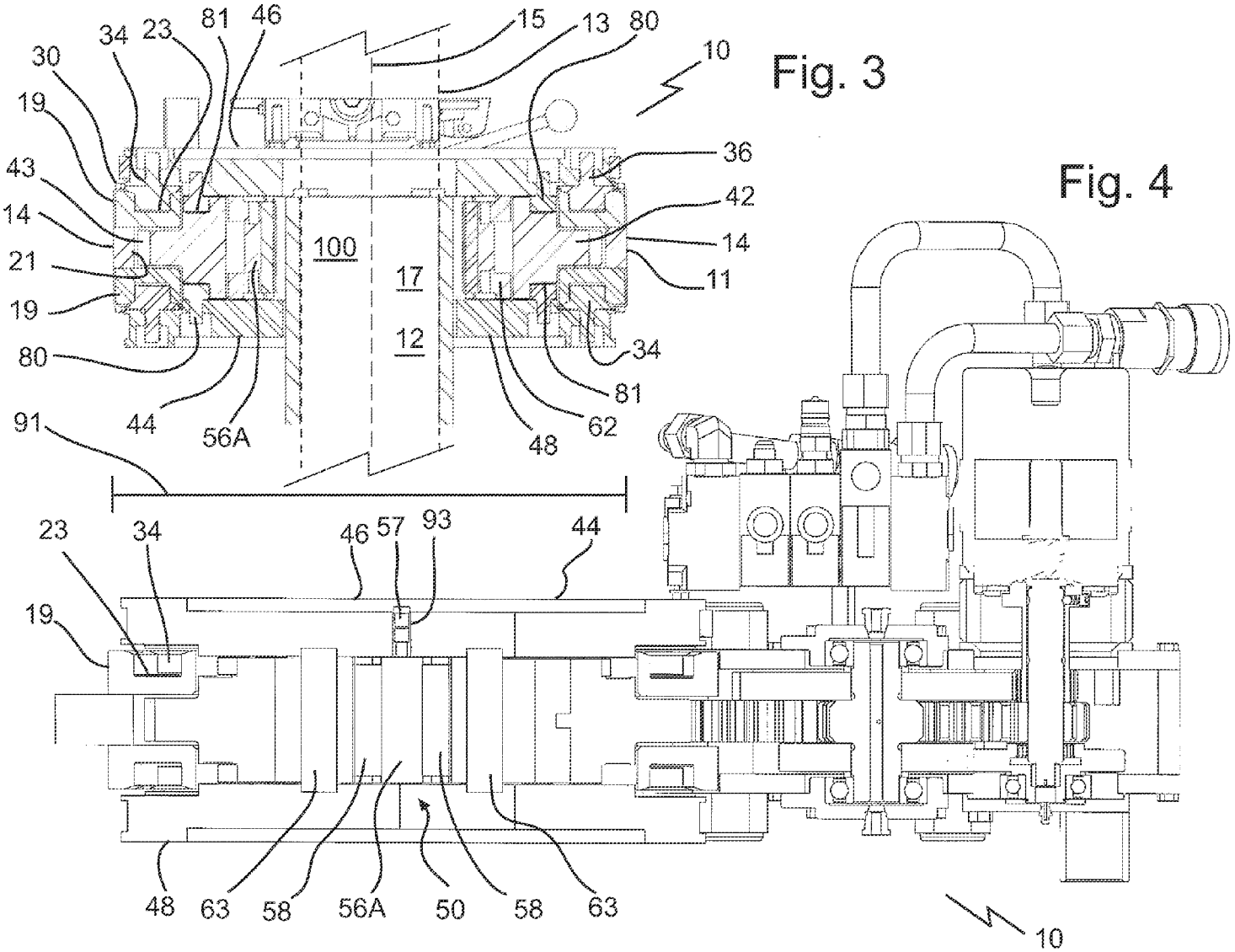
FIG. 3 is a cross-section view taken along the 3-3 section lines of FIG. 1, and with a pipe illustrated in dashed lines and positioned within the open throat of the power tong.
FIG. 4 is a cross-section view taken along the 4-4 section lines of FIG. 1.

Frame 11 has a pair of arcuate front portions 14 defining a throat 12 for receiving the pipe 13 (shown in FIG. 3). Referring to FIGS. 2 and 3, cage plate assembly 44 is mounted for rotation on the arcuate front portions 14 about a center of rotation 15, the cage plate assembly 44 having an opening 17 that is alignable with the throat 12. The cage plate assembly 44 may be mounted for rotation to the arcuate front portions by an upper cage plate 46 mounted above the arcuate front portions 14, and a lower cage plate 48 mounted below the arcuate front portions 14. Mounting of the cage plate assembly 44 may be through bearing rings 19, for example upper and lower bearing rings 19 as shown. Referring to FIG. 3, bearing rings 19 may be spaced to define a groove 21 in which gear teeth 43 of ring gear 42 may spin, although this is not necessary.

Ring gear 42 is mounted for rotation within, and supported by, the cage plate assembly 44 about the center of rotation 15, the ring gear 42 having an opening 100 that is alignable with the throat 12. The ring gear 42 may be mounted for rotation within, and supported by, the cage plate assembly 44 through various bearing or sliding surfaces such as using one or more of a plurality of support rollers 80 that roll in annular recesses 81. A bushing slide surface may be used in some embodiments. By supporting the ring gear 42 within the cage plate assembly 44, the ring gear 42 rides within the cage plate assembly 44 and the assembly 44 takes the majority, if not all, of the force from the ring gear in use. This is advantageous over tong designs that transfer force from the ring gear 42 directly to the frame 11, because the cage plate assembly 44 may be rigid and have a relatively high degree of section modulus. The plates 46 and 48 may be solid for increasing the rigidity of cage plate assembly 44. The disclosure provided herein may provide a narrower and more compact power tong 10 to be constructed, reducing space, weight, and cost of construction and operation. Referring to FIG. 3, in this respect, cage plates 46 and 48 may effectively define at least one maximum transverse dimension of power tong 10, such as the lateral width 91 along section lines 3-3 (shown in FIG. 1) as shown. The ring gear 42 cooperates in conventional manner with jaws, which may comprise dies 58 held by die carriers 56A, mounted on the cage plate assembly 44 for gripping the pipe 13 upon rotation of the ring gear 42. The ring gear 42 may include a plurality of cam surfaces (not shown in FIG. 1 or 2, but illustrated by surface 67 in FIG. 5A) disposed circumferentially about the center of rotation 15 for cooperation with the jaws (only one of which is illustrated in the Figures). In FIG. 2, spring return guide pin 57 is connected to the die carrier 56A and biased by a spring (not shown) to bias the corresponding jaw to a retracted position. Pressure of the cam surface on ring gear 42 from rotation of the ring gear 42 in relation to the cage plate assembly 44 forces the jaws to close in conventional fashion.

Referring to FIG. 1, a door (not shown) may be pivotally mounted to the frame 11, adjacent to the throat 12 to allow a tubular section 13 to be placed in throat 12 of the power tong 10. A door latch mechanism (not shown) may also be provided for cooperation with a corresponding hook (not shown) mounted to the opposite door, so that for the safety of the operator the door 20 can be securely locked in the closed position.

Referring to FIG. 3, as disclosed the frame 11 may include upper and lower bearing rings 19 spaced apart with arcuate front portion 14 between them and bolted together with bolts 30. The pair of arcuate front portions 14 surround the cage plate assembly 44 and ring gear 42 and define a throat 12 for receiving a tubular section 13 to be threaded to another tubular.

The arcuate front portions 14 may be designed such that under normal operating conditions (equal to or lower than full rated torque) the front portions 14 will flex more than cage plate assembly 44. This objective may be realized by the selection of the materials forming the front portions 14 and the transverse width of the front portions 14 (transverse is defined in relation to the direction of the opening of the throat 12, which is oriented in the longitudinal direction). In the design shown, strain resulting from the torque of the ring gear 42 during operation may be primarily taken up by the relatively rigid cage plate. The front portions 14 of the frame may be designed to flex without reaching their maximum yield strength. The resistance for the flex may never be greater than the force the flanged rollers 34 can withstand before breaking. The front portions 14 of the frame 11 may only flex enough to accommodate the circumferential increase of the ring gear 42 when it is operating to the maximum rated torque. The ring gear 42 and cage plate assembly 44 may be designed to take the entire load applied to them by the die carriers 56A and 62, without reaching their maximum yield strength. The ring gear 42 and cage plate assembly 44 combination may also be designed rigidly enough so that when under full torque they will not increase circumferentially more than the gear train backlash will allow.

Referring to FIG. 4, as discussed above, a plurality of flanged rollers 34 may be mounted around a groove 23 in periphery of the front portions 14, for example bearing rings 19. The flanged rollers 34 are shown in FIG. 3 and are rotatably mounted on a substantially vertical shaft or bolt 36 and held in place by a nut (not shown). A washer may also be located between the nut and the cage plate assembly 44.

Referring to FIG. 4, a tubular section gripping mechanism 50 may be provided within the front portions 14 of the frame 11 and surrounding the throat 12. The pipe gripping mechanism 50 may include ring gear 42. Referring to FIG. 3, the ring gear 42 may be guided on its outer periphery and retained within the cage plate assembly 44 by rollers 80. Rigidly secured to the outer periphery of the projection of the ring gear 42 may be gear teeth 43.

Referring to FIG. 4, the pipe gripping mechanism 50 may further include the jaws mounted on the cage plate assembly 44. Jaws comprising die carriers shown in FIG. 4 are sliding die carriers 56A, although other types of die carriers may be used. The cage plate assembly 44 may include upper and lower arcuate plates 46 and 48, respectively, spaced apart for example by spacers such as guide plates 63. Rollers 80 may be provided to rotatably mount and support ring gear 42 within cage plate assembly 44. This construction may permit radial loads applied to the ring gear 42 to be fully supported by the rollers 80, which in turn are supported by the cage plate assembly 44.

Referring to FIG. 1, mounted to the frame 11 may be an arcuate brake band 84 terminating in a flange 85 as is known in the art. The brake band 84 at least partially surrounds and frictionally engages the outer periphery of the upper cage plate 46 to restrain cage plate assembly 44 from initial movement with the ring gear 42, in order to allow engagement and operation of the cam-operated dies for gripping the pipe 13. It is understood that the above brake band 84 may also be mounted to run on the bottom cage plate 48.

Figure 5A:
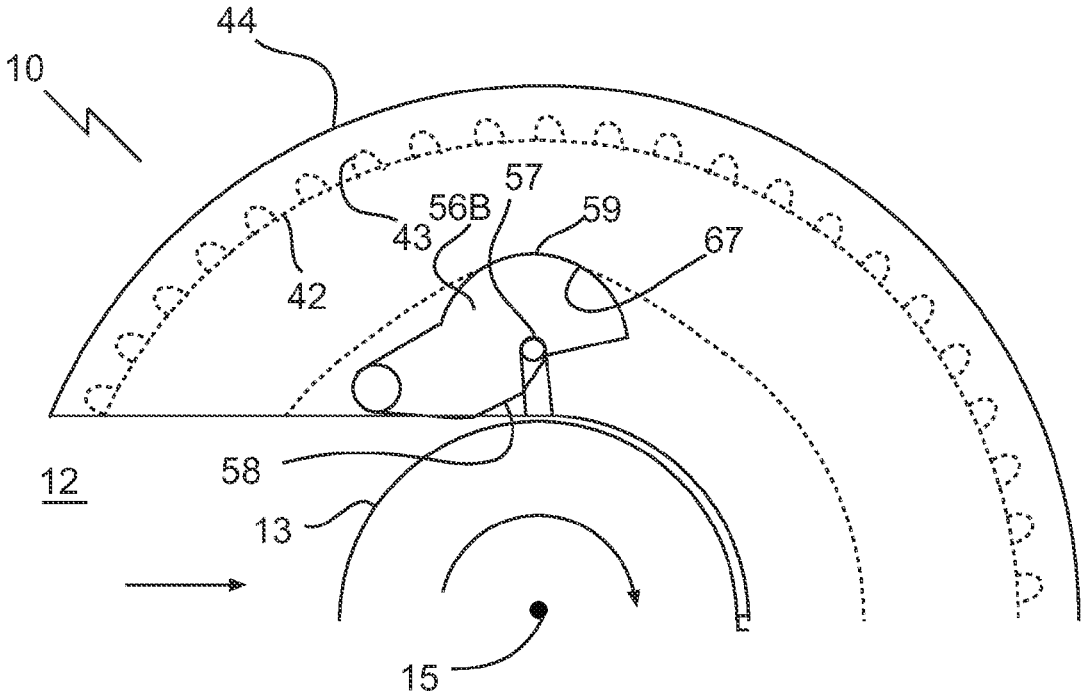
FIGS. 5A-B are plan views that illustrate an example of the cam operation of a pivoting die carrier.
Figure 5B:
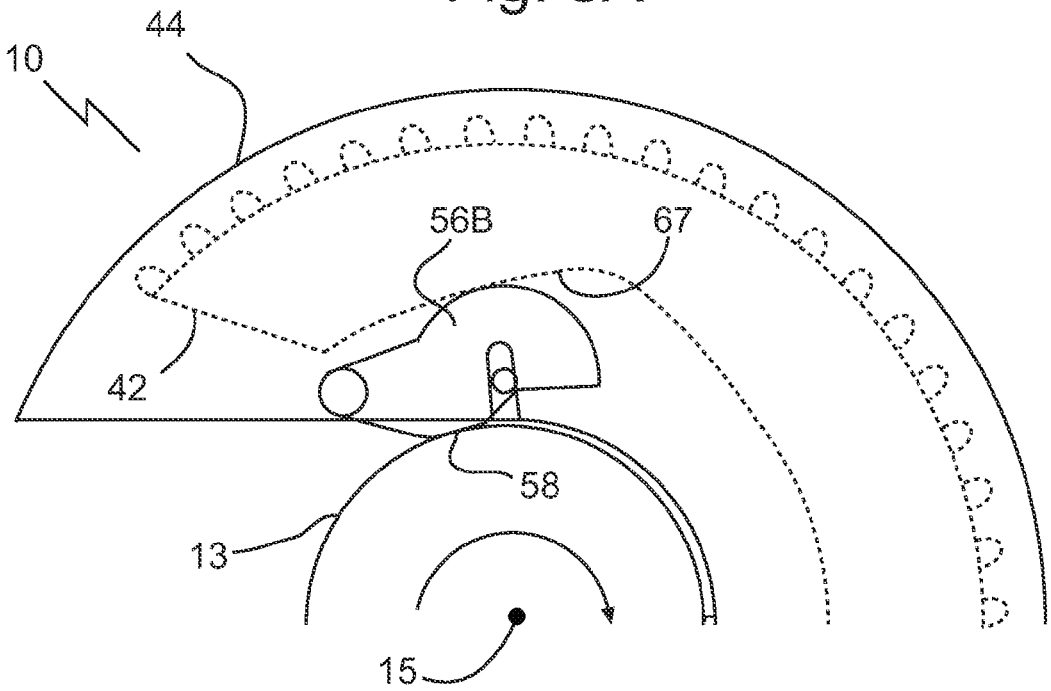

Referring to FIG. 5A, an example of a pivoting jaw is illustrated by die carrier 56B carrying dies 58, with the die carrier 56B pivotally mounted on the cage plate assembly 44 on either side of the throat 12, only one jaw being shown in FIG. 5A. As with the jaws of FIGS. 1-4, the jaws are operated by cooperation of a cam follower 59, such as a roller, which follows cam surface 67. Referring to FIGS. 5A-B, operation of an exemplary hinged jaw is illustrated as ring gear 42 begins to rotate and die 58 is forced into engagement with tubular 13. Upon further rotation of ring gear 42 in the same direction, cage plate assembly 44 will rotate along with ring gear 42.

Referring to FIGS. 2 and 4, the jaws may comprise a pair of dies 58 carried by die carriers 56A with the jaws being attached to a central cam follower (not shown). Upon rotation of ring gear 42, the cam follower forces the jaws to slide inwards to grip tubular 13. Referring to FIG. 4, the jaws are guided by guide plates 63 secured to the upper and lower cage plates. Pin 57 is connected to the die carrier 56A and spring mounted in relation to the cage plate in conventional manner to urge the jaws inward. Thus, in FIG. 4, when ring gear 42 rotates, cam follower 59 is pushed out of the plane of the figure, thus also pushing dies 58 out of the plane to engage a tubular (not shown). The dual sliding die arrangement shown ensures that force is evenly distributed and controlled so that the tube is gripped tightly enough to allow proper torque to be applied without crushing or damaging the pipe. Although not shown in FIG. 4, an opposing die carrier arrangement of similar or identical construction may be provided on the other arcuate front portion 14.

Referring to FIG. 2, the ring gear 42 may be rotated relative to the frame 11 by means of a drive train 71, which may include various components such as a motor drive gear 70 which meshes with various other gears as is known in the art, and which mesh with the gear teeth 43 on the ring gear 42. The drive train is powered by a motor 78. It will be understood that any conventional motor may be employed which is capable of rotating the motor drive gear 70 in either direction, for example a dual speed hydraulic motor. It will be further understood that the spacing of gears may be such that at least one of the gears is always in driving engagement with the gear teeth 43 of the ring gear 42, even when the opening of the ring gear 42 is toward the rear end of the power tong assembly. It should also be understood that the sequence of gears may contain enough backlash during normal operation to allow for the radial expansion of the ring gear 42. The backlash may not exceed industry accepted standards. These standards may be found in standard machinist handbooks. The ring gear flex is related to the change in the circumferential size of the ring gear 42. This size change is noticed in the throat of the ring gear. When the throat of the ring gear faces rearward, this size change is taken up by the backlash in the gear train.

As will be appreciated, the power tong may be capable of rotating the tubular section in either direction. When the power tong is operating to full torque screwing together or taking apart tubular sections, the die carriers 56A or 56B roll up the cam surfaces 67 thus causing a radial and outward force to be applied to the ring gear 42. This force in turn is resisted by the ring gear 42 and cage plate assembly 44. By mounting the ring gear 42 on the cage plate assembly 44, the cage plate assembly 44 absorbs this radial force effectively, restricting the amount that the tong 10 will flex open. The cage plate assembly 44, and front portions 14 may be designed to flex open before overloading of the flanged rollers 80.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A power tong for rotating a pipe, the power tong comprising:

a frame having a pair of arcuate front portions defining a throat for receiving the pipe;

a cage plate assembly mounted for rotation on the arcuate front portions about a center of rotation, the cage plate assembly having an opening that is alignable with the throat, the cage plate assembly further comprising an upper cage plate and a lower cage plate mounted for rotation above and below, respectively, the arcuate front portions; and a ring gear mounted between, and supported by, the upper cage plate and the lower cage plate for rotation about the center of rotation independently from the upper cage plate and the lower cage plate, the ring gear having an opening that is alignable with the throat;

the ring gear cooperating with jaws mounted on the cage plate assembly for gripping the pipe upon rotation of the ring gear.

2. The power tong of claim 1 in which the cage plate assembly is mounted for rotation on one or more bearing rings of the arcuate front portions.

3. The power tong of claim 1 in which the ring gear is mounted for rotation between, and supported by, the upper cage plate and the lower cage plate through a plurality of rollers.

4. The power tong of claim 2 in which the ring gear is mounted for rotation between, and supported by, the upper cage plate and lower cage plate through a plurality of rollers.

* * * * *